US005090577A

United States Patent [19]

Lehmann

[11] Patent Number: 5,090,577

[45] Date of Patent: Feb. 25, 1992

[54] MERCHANDISING DISPLAY UNIT WITH IMPROVED DIVIDER

[76] Inventor: Paul F. Lehmann, 1855 N. Custer Rd., Monroe, Mich. 48161

[21] Appl. No.: 688,868

[22] Filed: Apr. 22, 1991

[51] Int. Cl.[5] ..... A47F 5/00

[52] U.S. Cl. ..... 211/86; 211/88; 211/184

[58] Field of Search ..... 211/184, 88, 86, 59.4, 211/126

[56] References Cited

U.S. PATENT DOCUMENTS

| | | | |
|---|---|---|---|
| 2,733,113 | 1/1956 | Humbargar | 211/88 X |
| 4,047,615 | 9/1977 | Brown | 211/88 |
| 4,154,356 | 5/1979 | Schieve | 211/88 X |
| 4,403,700 | 9/1983 | Manlove | 211/88 |
| 4,962,860 | 11/1990 | Lehmann | 211/88 |

*Primary Examiner*—Blair M. Johnson
*Attorney, Agent, or Firm*—Willian Brinks Olds Hofer Gilson & Lione

[57] ABSTRACT

A merchandising display unit particularly suited for storing and displaying groups of small items of variable sizes such as nails, bolts, and similar hardware. The basic unit includes an elongate horizontal channel having a rigid arcuate wall extending substantially 180 degrees around the horizontal axis to provide a partial enclosure having an upper elongate slot providing access and visibility to the contents therein. Each end of the channel has a fixed transverse barrier. One or more dividers are transversely positioned between the end barriers to provide separated segments or item compartments. Each divider has a generally linear upper surface, and a generally arcuate lower periphery that is coextensive with the arcuate wall of the channel and has a diameter slightly larger than that of the channel. Each divider may be placed anywhere along the axis of the channel to form item compartments of desirable length. Each divider may be placed anywhere along the axis of the channel to form item compartments of desirable length. Each divider also has a finger-like projection whereby a dividing rod may be attached. The dividing rod separates items positioned adjacent to the display unit.

2 Claims, 1 Drawing Sheet

MERCHANDISING DISPLAY UNIT WITH IMPROVED DIVIDER

SUMMARY OF THE INVENTION

This invention is an improvement on my now issued U.S Pat. No. 4,962,860 for a merchandising display unit. The invention includes a horizontally extending channel-shaped body of arcuate cross section in which the channel body extends through an arc about its horizontal axis of greater than 180 degrees to provide a partial enclosure and an open slot for access and visual inspection of the contents therein. The horizontal channel body is attached to a fixed support surface by one or more suitable fasteners extending through the wall of the channel.

The invention features horizontally adjustable dividers positioned between end barriers which serve to separate the horizontal body into compartments for holding individual items such as hardware or other small items. The dividers are an arcuate shaped disk corresponding to the cross section of the channel body but have a slightly larger arcuate circumference than the corresponding arcuate circumference of the channel so that they are firmly gripped when inserted within the channel body. The dividers have a finger-like projection which extends outwardly beyond the periphery of the disk to allow the attachment of a dividing rod. The dividing rod separates items positioned adjacent to the display for ease of storage and inventory.

OBJECTS OF THE INVENTION

It is an object of the present invention to provide a merchandising display unit of the type described in which selectively movable dividers can be positioned anywhere along the axis of the unit, spaced apart by the desired length of the unit to be stored in convenient multiples thereof, etc.

It is another object of this invention to provide such a divider which is arcuate in shape, having an arcuate circumference slightly larger than that of the arcuate circumference of the channel unit, such that the divider may be slightly forced into its transverse position, stressing the channel unit to exert force on the divider to hold it in position.

It is still another object of this invention to provide such a divider with a finger-like projection which extends outwardly beyond the periphery of the disk to allow the attachment of a dividing rod, so that items positioned adjacent to the display unit may be separated for ease of storage.

For further understanding of the present invention and the objects thereof, attention is directed to the drawings and the following brief description thereof, to the detailed description of the preferred embodiment, and to the appended claims.

DETAILED DESCRIPTION OF THE INVENTION

Figure 1:
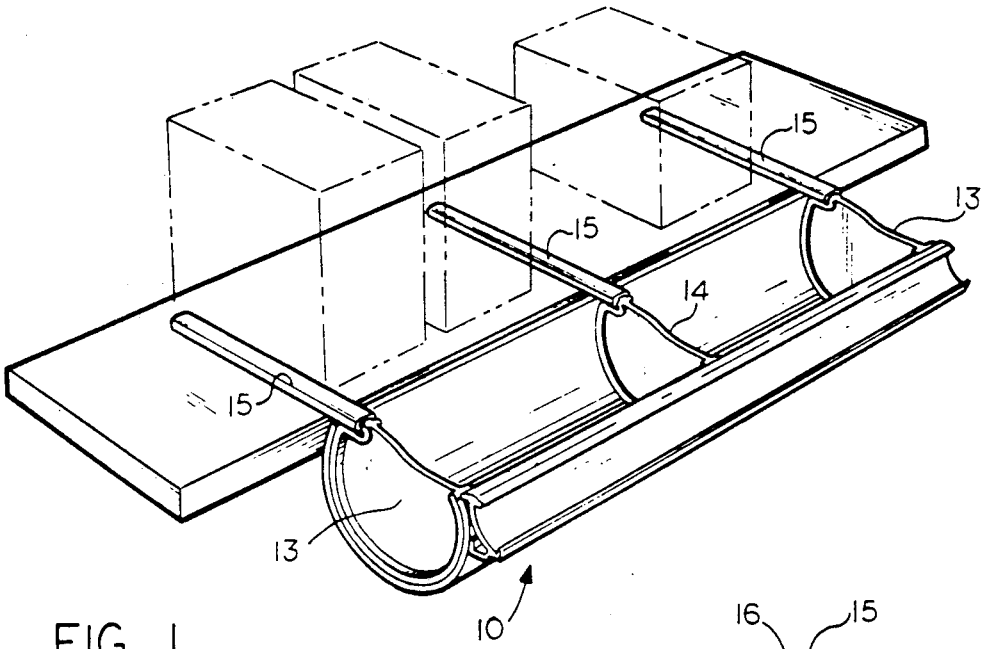
FIG. 1 is a view in perspective of the preferred embodiment of the merchandising display unit according to the present invention.

Referring to FIG. 1, each display unit consists of an elongate channel 10 having a length corresponding to the shelf or vertical support surface to which it is attached. Commonly, these units will be attached to the edges of vertically stacked shelves and be coextensive in length so that the parts displayed therein can be stored on the shelves in their boxes, with only a small number of parts being displayed in the unit.

The channel member itself is preferably fabricated from a length of extruded plastic pipe, such as three to eight inch diameter polyethylene pipe which is commonly made for liquid transport. The advantages of using such pipe are several: it is relatively inexpensive, readily available, can be cut and custom installed with portable hand tools, and comes in different colors so that an attractive display can be built. A relatively unskilled worker such as a store clerk or general repair person, can easily master installation of these units.

As shown, the pipe has a slot of about 120 degrees so that the remaining arc of the pipe is sufficient to provide a partially enclosed channel to hold the units and yet the slot of 120 degrees provides enough space for a visual inspection of the contents and manual access thereto. The slot can vary between 90 and 120 degrees and still leave sufficient channel structure to keep parts from falling out, although at least 200 degrees is desirable at the minimum to grip the dividers, as seen below, enough of the arcuate wall to provide an enclosure to keep parts from falling out.

As best seen in FIG. 1, the extreme ends of the channel 10 are closed by an end barrier 13 which may be permanently attached, as with adhesive or other securing means. Intermediate the ends are a plurality of divider disks 14 which are positioned along the length of the channel 10 to separate it into individual compartments. These disks have a thickness sufficient to prevent their twisting in the channel 10. For example, a disk of ⅛ inch material has been found to be satisfactory. One of the primary advantages of this invention is that the divider 14 may be moved to the exact length of the part being stored so that the display system is universal in that it can accommodate any size parts, etc. For example, if the display were to be used with bolts in a hardware store, each divider would be positioned so that the distance to an end barrier 13 or another divider 14 would be exactly that necessary to receive a number of bolts of each particular length, placed in parallel horizontal position. As seen in FIG. 1, the boxes storing these bolts can be positioned directly above the compartments so that each compartment displays the parts which are contained in their shipping boxes immediately above. The dividing rods 15 allow items positioned adjacent to the display unit to be separated.

Figure 3:
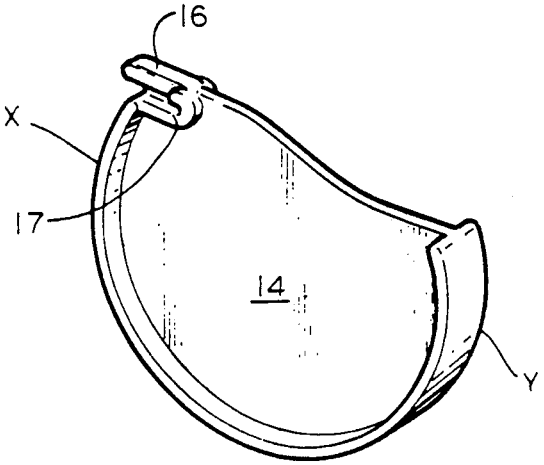
FIG. 3 is a view in perspective of one of the divider disks.

The arcuate divider 14 is composed of preferably the same thermoplastic material as the channel 10. The arcuate circumference of the divider 14, measured between points X and Y, as shown in FIG. 3, is slightly larger than the unstressed arcuate circumference of the channel 10 or of the pipe forming it, so that when fully installed in its transverse position, the divider 14 is held in place and stresses the arcuate channel 10 which opens slightly to grasp the divider 14 and maintains force on it to hold it in position. As will be apparent, the force on the divider 14 is exerted by opposed edges of the channel 10 which must extend substantially about 180 degrees to maintain and grip on the divider 14.

Figure 4:
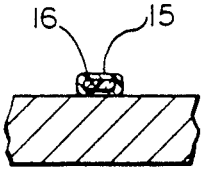
FIG. 4 is a front view taken along line 4—4 of FIG. 2 of the dividing rod and fixed support surface.
Figure 2:
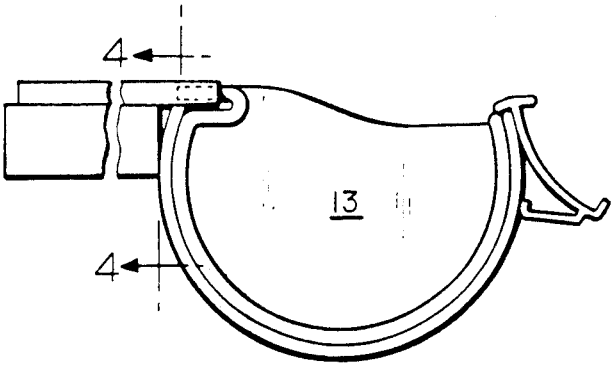
FIG. 2 is an end view of the unit of FIG. 1 showing the manner in which the dividing rod is attached to the transverse divider.

The arcuate divider 14 also includes a support structure which allows the dividing rods 15 to be slidingly attached thereto. The support structure includes a finger-like projection 16 which extends outwardly beyond the periphery of the disk, and two ridges 17 which connect to the finger-like projection 16 forming a groove. As seen in FIG. 4, the rod 15 is hollow and complementary in shape to the cross section of the finger 16 so that it slides over and is retained upon the finger 15 with a loose frictional engagement.

It will be apparent to those skilled in the art that the invention described above provides a number of advantages over the prior art display fixtures. Firstly, because it is fabricated from readily available lengths of thermoplastic pipe, a hardware store owner, clerk, or semi-skilled installer can easily fabricate the custom shelves. Secondly, because such pipes are available in a number of colors, attractive displays can be fabricated or the displays may be color coded to indicate different items in different colors, such as metric threads in one color and English standard threads in another, etc. Thirdly, the divider disks 14 can also be fabricated from inexpensive thermoplastic sheets of different colors so that the start of one type of part can be indicated by a color on each end, etc. The provision of finger-like projections 16 on the divider disks 14 allowing the attachment of a dividing rod 15 is a useful advantage in that items positioned adjacent to the display unit can be easily separated for ease of storage.

Other advantages of the invention will be apparent to those skilled in the art and various changes may be made from the above-described embodiment, without departing from the scope and spirit of the following claims.

I claim:

1. In a merchandising display unit having an elongate horizontal channel of uniform interior diameter formed by a rigid arcuate wall extending substantially 180 degrees about a horizontal axis to provide a partial enclosure with a bottom, opposed sides, and an open top, and having transverse barriers on each end and at least one transverse divider intermediate said end barriers, the improvement comprising said transverse divider having a generally arcuate lower periphery coextensive with said arcuate wall of said channel, and an upper surface extending generally linearly between opposed upper edges of said arcuate lower periphery whereby, when said transverse divider is positioned transversely of said elongate channel, its arcuate lower periphery is coextensive with the rigid arcuate channel wall and its linear upper surface extends directly between the opposed sides of said channel across said open top, said transverse divider comprising a planar wall extending between said arcuate lower periphery and said linear upper surface and further including an arcuate external rib coextensive with said arcuate lower periphery and said linear upper surface and further including an arcuate external rib coextensive with said arcuate lower periphery and extending normal to the planar wall, said transverse divider further including a support means located at one upper edge of said arcuate lower periphery of said divider, said support means comprising a finger-like projection extending outwardly beyond the upper edge of said arcuate lower periphery whereby a dividing rod is releasably supported thereby, wherein said support means further includes a stopping means consisting of two generally J-shaped ridges located on both faces of the transverse divider, said J-shaped ridges extending perpendicularly to the upper edges of said arcuate lower periphery, said J-shaped ridges further connecting to said finger-like projection such that a groove or slot is formed.

2. The merchandising display unit of claim 1 wherein said dividing rod is slidingly attached to said finger-like projection of said supporting means and extends outwardly beyond said channel so that items positioned adjacent said display unit are separated by said dividing rod.

* * * * *